US005567129A

United States Patent [19]

Bonardi

[11] Patent Number: 5,567,129

[45] Date of Patent: Oct. 22, 1996

[54] THRUST CONTROL SYSTEM FOR GAS-BEARING TURBOCOMPRESSORS

[76] Inventor: G. Fonda Bonardi, 2075 Linda Flora Dr., Los Angeles, Calif. 90077

[21] Appl. No.: 452,640

[22] Filed: May 25, 1995

[51] Int. Cl.[6] ..... F01D 3/00; F04B 17/00; F04D 29/04

[52] U.S. Cl. ..... 417/365; 417/407

[58] Field of Search ..... 417/405, 407, 417/365

[56] References Cited

U.S. PATENT DOCUMENTS 2,864,552 12/1958 Anderson ..... 417/365
4,808,070 2/1989 Bonardi .

FOREIGN PATENT DOCUMENTS 60-147538 8/1985 Japan ..... 417/407
60-173316 9/1985 Japan ..... 417/407
61-126327 6/1986 Japan ..... 417/407
1315307 5/1973 United Kingdom ..... 417/407

*Primary Examiner*—Michael Koczo
*Attorney, Agent, or Firm*—James E. Brunton

[57] ABSTRACT

A thrust control system for use with a turbocompressor having gas bearings in which the average static pressure in the compressor housing differs substantially from the average static pressure in the expander housing which, during operation of the turbocompressor, will reduce the net resulting thrust to nearly zero without compromising the performance of the turbocompressor. In one embodiment of the invention, the thrust control system includes a pair of gas-dynamic thrust bearings and one compensation chamber with prescribed area and pressure ratios such that under static conditions the equilibrium position of the rotating assembly portion of the turbocompressor is in the center of the axial clearance range and under dynamic conditions the maximum displacement from center does not exceed the existing clearance.

11 Claims, 3 Drawing Sheets

1.0
P-Pe
Pg-Pe
0.5
0
R2
C= 0
1
2
4
1
1.5
2.0
R2/R1, R3/R1

F
DPe
7
6
5
4
R1 = 1.2
R2 = 1.8
R3 = 2.0
0
0.5
1.0
b2/b1

THRUST CONTROL SYSTEM FOR GAS-BEARING TURBOCOMPRESSORS

BACKGROUND OF THE INVENTION

1. Field of the Invention

The present invention relates generally to gas bearing turbocompressors. More particularly, the invention concerns turbocompressors embodying gas bearing wherein the average static pressure in the compressor housing differs substantially from the average static pressure in the expander housing.

2. Discussion of the Prior Art

Gas bearings have been in use for many years in applications wherein a shaft rotates at very high speeds within a stationary journal. The well-known advantages of these devices are very low frictional losses and lack of a complex oil lubricating system, usually comprising an oil reservoir, oil pump, filters, coolers pressure gauges, valves and related hardware.

In all fluid-supported bearings, the hydrodynamic action which generates dynamic pressures within the space between the shaft and the journal is caused by the motion of a viscous fluid (whether oil or gas) which is forced to flow in a gap of varying width by the relative motion of the shaft within the journal. In the simplest case of a cylindrical shaft rotating in a cylindrical journal, the variation in the width of the gap is the consequence of an eccentricity of the shaft in the journal, such as may be caused by the weight of the shaft or other externally applied forces. This simplest bearing is stable under certain conditions, but becomes unstable when the combination of applied forces and rotational speed exceeds a certain value. Furthermore, the load-carrying capacity of the simple gas bearing is not very high.

Considerable ingenuity has been exercised in introducing modifications to the cylindrical surface of the journal to achieve a more effective variation of gap width for smaller values of eccentricity. These prior art endeavors have resulted in a variety of shapes being proposed, as for example, three-lobe bearings, lemon-shaped bearings, half lemon-shaped bearings, and displaced bearings.

A substantial improvement over prior art fluid-bearing devices is disclosed in U.S. Pat. No. 4,808,070 issued to the present inventor. The device described in this patent includes a novel fluid bearing which retains all of the advantages of prior art gas bearings, but obviates the difficulty and expense of manufacture of such devices by substantially relaxing the dimensional tolerances required. This patent also describes a fluid bearing which is intrinsically stable under widely varying operating conditions. Because of the relevance of U.S. Pat. No. 4,808,070 to a complete understanding of the present invention, this patent is hereby incorporated by reference as though fully set forth herein.

The thrust of the present invention is directed toward the solution to problems resulting from the use of gas bearings in turbocompressors wherein the average static pressure in the compressor housing differs from the average static pressure in the expander housing or vice versa. By way of example, such a condition is found in the upper stages of a multi-stage chain of compressors arranged in series driven by expanders arranged in parallel. In such cases the rotating assembly consisting of the gas-bearing shaft, the expander wheel, the compressor wheel and any thrust bearings, is subjected to an axial force (thrust) equal to the difference of pressure at the two ends of the shaft times the area of the shaft cross section. Since gas bearings in a thrust-resisting configuration are not as stiff as oil bearings in similar service, it is necessary to provide equalizing means for reducing the net resulting thrust to as close to zero as is possible without otherwise compromising the performance of the turbocompressor. A primary object of the present invention is to provide such equalizing means.

SUMMARY OF THE INVENTION

It is an object of the present invention to provide a thrust control system for use in combination with a turbocompressor having gas bearings in which the average static pressure in the compressor housing differs substantially from the average static pressure in the expander housing which, during operation of the turbocompressor will reduce the net resulting thrust to nearly zero without compromising the performance of the turbocompressor.

More particularly, it is an object of the invention to provide an apparatus of the aforementioned character in which the thrust control system comprises a pair of gas-dynamic thrust bearings and one compensation chamber with prescribed area and pressure ratios such that under static conditions the equilibrium position of the rotating assembly portion of the turbocompressor is in the center of the axial clearance range and under dynamic conditions the maximum displacement from center does not exceed the clearance.

Another object of the invention is to provide an apparatus as described in the preceding paragraphs which is of simple construction, but is very proficient and highly reliable in operation.

A further object of the invention is to provide a turbocompressor of the class described which is highly reliable and requires minimum maintenance.

DESCRIPTION OF THE INVENTION

Figure 1:
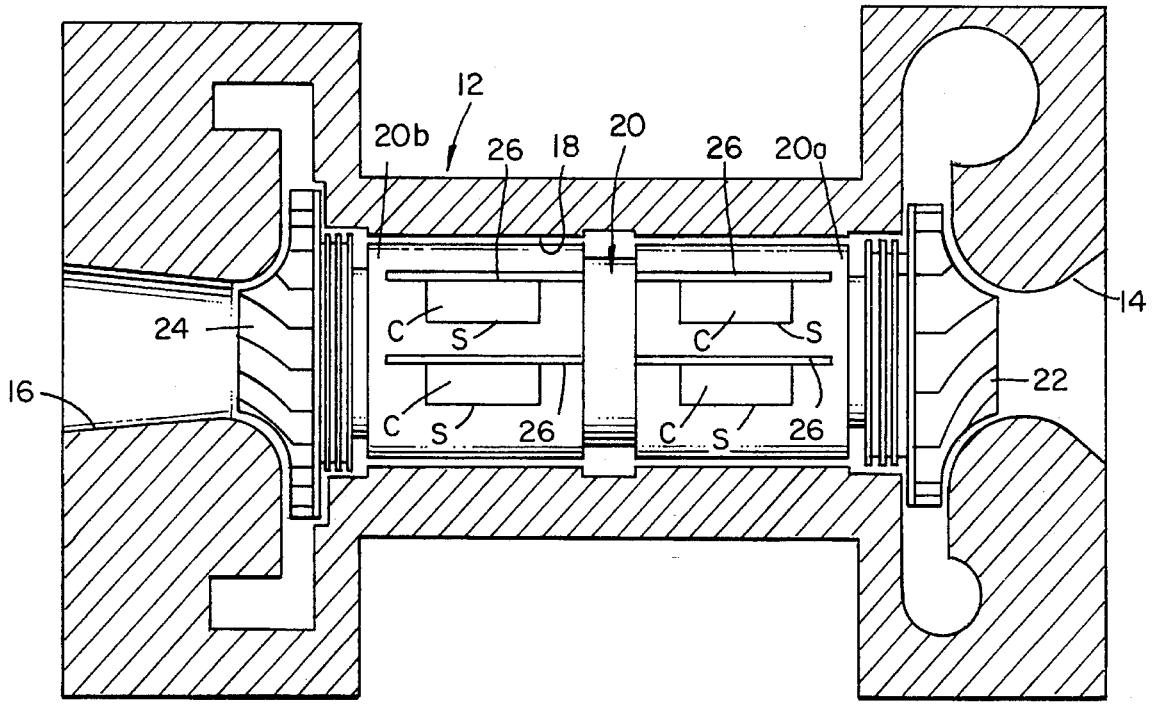
FIG. 1 is a diagrammatic, side-elevational, cross-sectional view of a gas bearing turbocompressor of conventional design.

Referring to the drawings and particularly to FIG. 1, a generally diagrammatic view turbocompressor of conventional design is there illustrated. This turbocompressor design, which does not include the novel thrust bearings of the invention, comprises a support housing 12 having an inlet port 14 and an outlet port 16. An internal bore 18 extends longitudinally of housing 12 and defines a smooth inner surface. Rotatable within bore 18 is a shaft 20 having first and second ends **20*a* and 20*b*. Connected to shaft 20 proximate end 20*a* is a compressor wheel 22. Connected to shaft 20 proximate opposite end 20*b* is an expander or turbine wheel 24. As indicted in FIG. 1**, compressor wheel 22 is disposed proximate inlet port 14 while turbine wheel 24 is disposed proximate outlet port 16.

U.S. Pat. No. 4,808,070, which was issued to the present inventor and which is incorporated herein by reference, describes in greater detail the construction and operation of the gas-bearing portion of the turbocompressor construction shown in FIG. 1. Reference should be made to this patent for additional details concerning the nature and operation of the gas-bearing portions of the turbocompressor. For example, as more fully described in U.S. Pat. No. 4,080,070, bore 18 is generally circular in cross section at any point and is of a predetermined diameter. The inner surface of the bore is preferably generally smooth and uninterrupted. Shaft 20 is of a predetermined diameter less than the diameter of bore 18 and defines an elongated outer surface. Formed in the outer surface of the shaft are a plurality of circumferentially spaced, longitudinally extending recesses or cavities "C" of a pre-determined depth. Each cavity "C" defines along one margin thereof a radially outwardly extending step "S" of a pre-determined height. Also formed in shaft 20 are a plurality of circumferentially spaced, longitudinally extending grooves or channels 26. As shaft 20 rotates, gas will be drawn into the space between the inner walls of the cylindrical bore and the outer surfaces of the shaft and will function to maintain precise concentricity of the shaft within the bore 18.

In a turbocompressor apparatus of the character shown in FIG. 1, the rotating assembly, which comprises shaft 20, compressor wheel 22 and turbine, or expander wheel 24, is subjected to an axial force, or thrust equal to the difference of pressure at the two ends of the shaft times the area of the shaft cross section. Since gas bearings in a thrust resisting configuration are not as stiff as oil bearings in similar service, it is necessary to provide means for reducing the net resulting thrust as close to zero as possible without otherwise compromising the performance of the turbocompressor. As previously mentioned, a primary object of the present invention is to provide such means.

In addressing this problem of thrust compensation, it should be noted that conventional gas bearings in an axial thrust resisting configuration attempt to generate a dynamic pressure increment by channeling the fluid in shallow grooves with complex geometry, which are expensive to make and do not provide a restoring force if the bearing does not rotate, as is the case before the turbocompressor starts. If a pressure difference already exists between the two ends of the shaft, the rotating assembly is pushed tight against the opposite thrust bearing, and the machine starts rotating under high friction conditions that may damage the facing surfaces. As will presently be described more fully, the apparatus of the present invention uses this pre-existing pressure difference to generate the pressure increment in the opposite thrust bearing which is sufficient to prevent contact between the facing surfaces by keeping the rotating assembly centered in its range of axial clearance.

Figure 3:
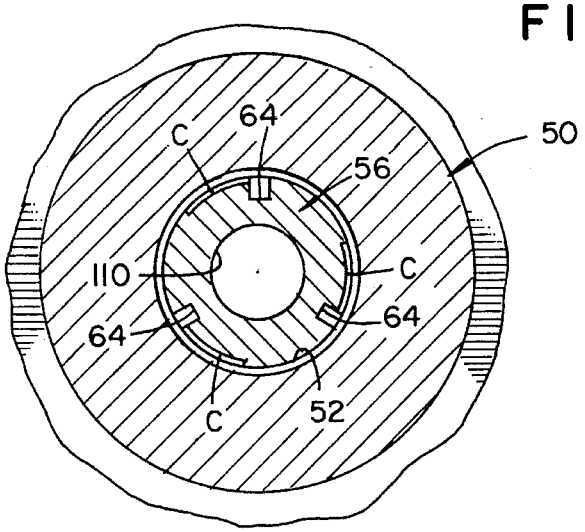
FIG. 3 is a cross-sectional view taken along lines 3—3 of FIG. 2.
Figure 2:
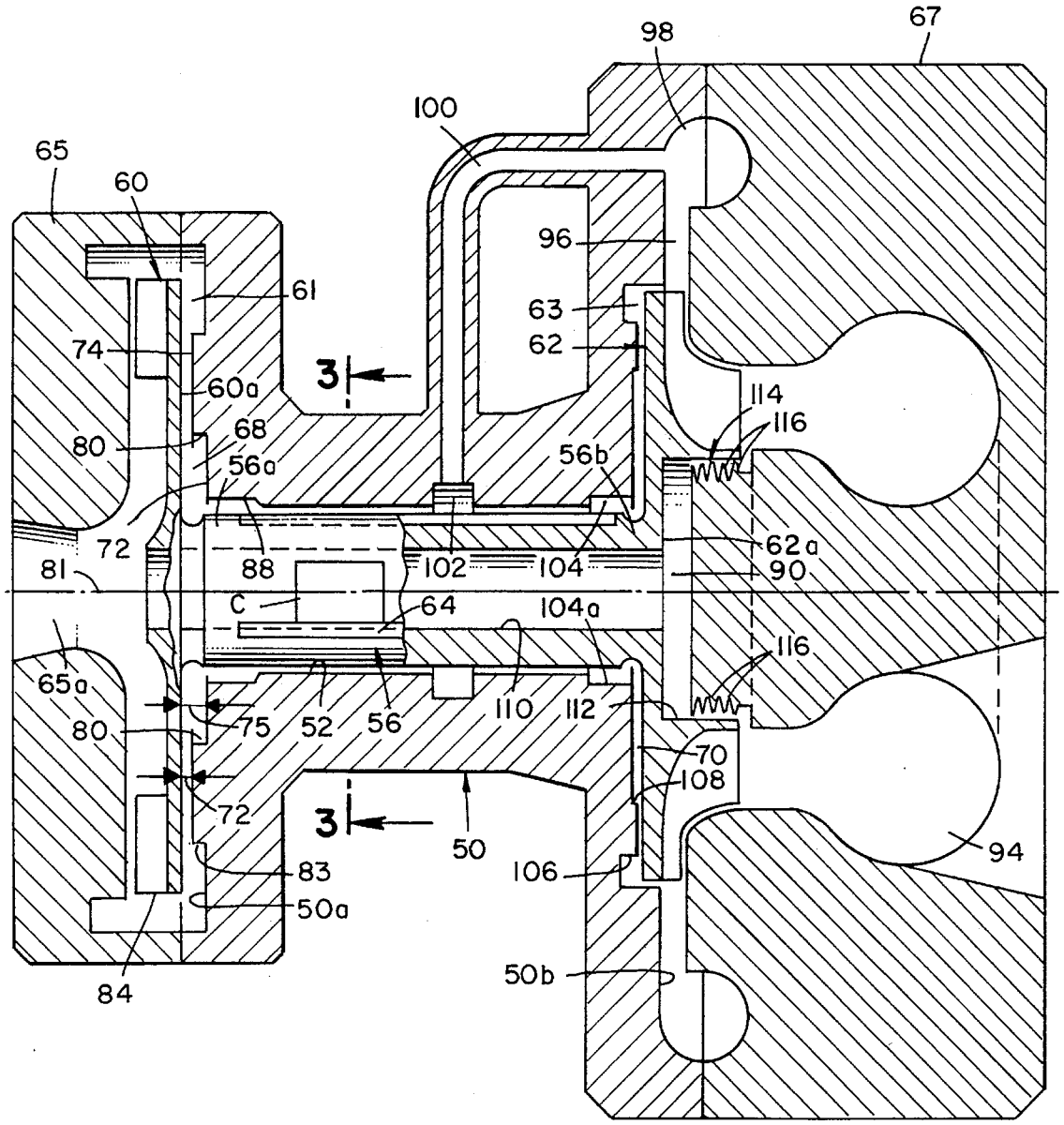
FIG. 2 is a diagrammatic, side-elevational, cross-sectional view of a gas bearing turbocompressor apparatus showing one embodiment of the present invention which includes thrust bearings.

Turning now to FIGS. 2 and 3 of the drawings, one embodiment of the turbocompressor of the present invention is there shown and can be seen to comprise a support housing 50 having longitudinally spaced first and second faces 50*a* and 50*b* respectively. Extending longitudinally of housing 50 is an internal bore 52 of uniform diameter. Rotatable within bore 52 is a shaft 56 having first and second ends 56*a* and 56*b* respectively. Connected to shaft 56 proximate end 56*a* is a first, or turbine wheel 60 and connected at the opposite end 56*b* of the shaft is a second, or compressor wheel 62. As shown in FIG. 2, wheel 60 rotates within a first chamber 61 while wheel 62 rotates within a second chamber 63. Chamber 61 is formed between a closure member 65 and support 50, while chamber 63 is formed between a closure member 67 and support 50. Bore 52 is generally circular in cross section at any point and presents an inner surface that is generally smooth and uninterrupted. Shaft 56 is of a diameter slightly less than the diameter of bore 52 and defines an elongated outer surface which is provided with a plurality of circumferentially spaced, longitudinally extending grooves or channels 64 (FIG. 3), as well as recesses or cavities "C" of predetermined depth.

An important feature of the present invention is the provision of thrust-compensating or equalizing means for maintaining the rotating assembly of the apparatus precisely axially centered within bore 52 of the support housing. The thrust-compensating or equalizing means here comprises first and second fluid thrust bearings generally designated in FIG. 2 by the numerals 68 and 70. Considering first thrust bearing 68, which is located proximate wheel 60 of the apparatus, this bearing comprises the volume disposed between the inboard surface 60*a* of the turbine wheel 60 and face portions 72 and 74 of support housing 50. As indicated in FIG. 2, face portion 72 is spaced from surface 60*a* by a gap distance identified by the numeral 75, while face 74 is spaced from surface 60*a* by a gap distance identified by the numeral 77. Forming a boundary between face portions 72 and 74 is a step 80, which is generally circular in shape and is concentric with the axis 81 of shaft 56. Outer edge 84 of turbine wheel 60 and a relief edge designated as 83, which functions to define the outer boundary of thrust bearing 68, are both concentric with axis 81. It is to be noted that the inner boundary of thrust bearing 68 is defined by an edge 88 which communicates directly with grooves 64 formed in shaft 56.

With the construction described in the preceding paragraphs, thrust bearing 68 is maintained at the same pressure as that prevailing within grooves 64. This pressure, hereinafter referred to as "Pg" is here presumed to be greater than external pressure "Pe" which is the pressure prevailing at relief edge 83. For present purposes, pressure "Pe" is presumed to be equal to the pressure at the edge 84 of turbine wheel 60. The pressure difference between "Pe" and "Pg" is defined as "DPe". If pressure "Pg" is higher than "Pe", the pressure difference "DPe" causes fluid, such as gas, to flow radially outwardly across the thrust bearing 68 in a direction toward relief shoulder 83. This radial flow establishes a pressure gradient from "Pg" to "Pe" which is dependent on the width of the gaps 75 and 77 and is a function of the radial distance from the axis of shaft 56. Both gaps 75 and 77 are here assumed to be so small that the flow is laminar; further, for present purposes, the gas is presumed to be at constant temperature substantially equal to that of the metal surfaces with which it is in contact.

Figure 4:
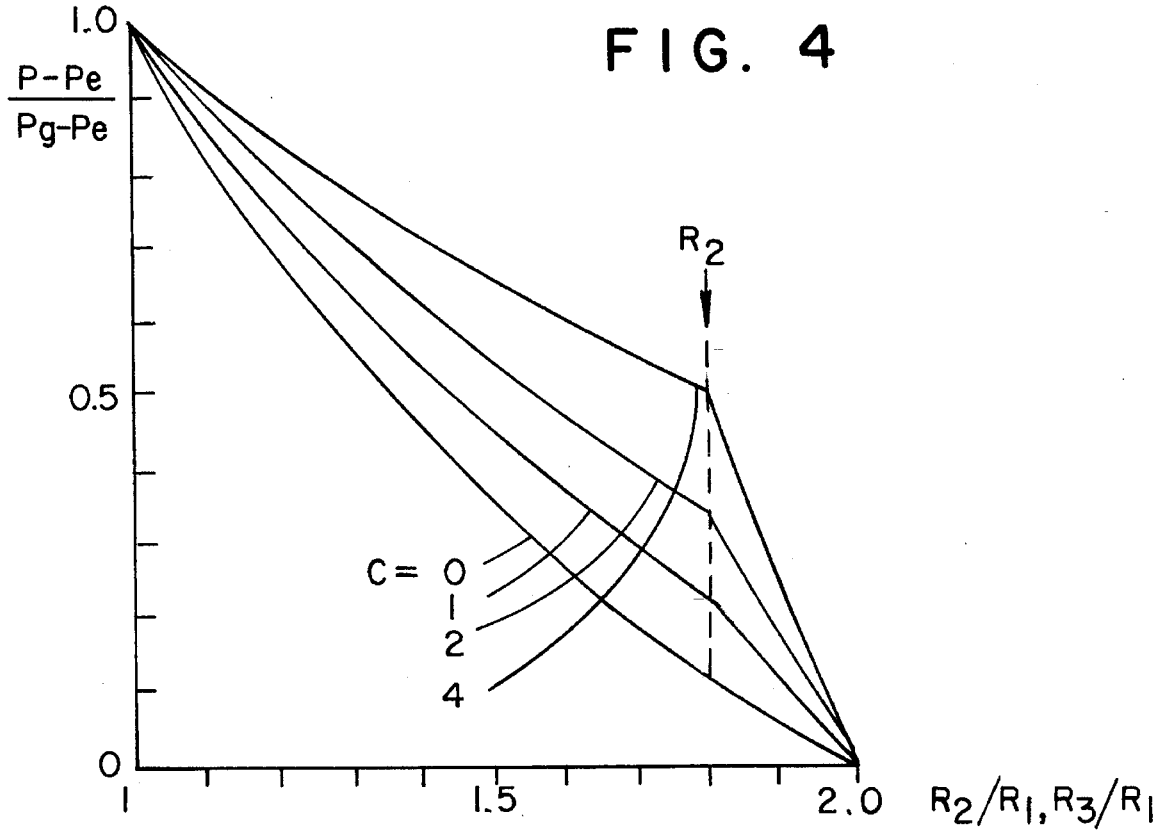
FIG. 4 is a graphical representation showing local pressures as a function of the geometry of the apparatus of the invention.

Expressed mathematically, the pressure gradient can be defined as:

$$dP/dr=-2vu/b$$

where V is the viscosity of the gas, u is the radial velocity of the gas and b the gap width. Defining b1 as the width corresponding to the width of gap 75 and b2 as the width of gap 77; defining as R1, the radius of edge 82; R2 as that of step 80, and R3 as that of edge 83, and then integrating, the local pressure P(r) is:

$$P=Pg+DPe \ln (r/R1)/(\ln (R2/R1)+c^3 \ln (R3/R2) \quad R1<r<R2$$

$$P=P2+cDPe \ln (r/R2)/(\ln (R2/R1)+c^3 \ln (R3/R2)) \quad R2<r<R3$$

where ln indicates the natural logarithm; c=b1/b2; and P2 is the pressure at the radius of step 80. The local pressure is a function of the geometry as defined by the ratios R2/R1, R3/R2, and c, and of the total pressure difference DPe. It is shown in FIG. 4 for a given position of step 80 and various values of the ratio c, corresponding to a fixed step b1-b2 and a varying clearance b2. The total force developed by the bearing is equal to the integral of the pressure over the area of the bearing:

$$Fe = 2\pi \int_{R1}^{R3} P\,r\,dr = 2\pi \int_{R1}^{R2} P\,r\,dr + 2\pi \int_{R2}^{R3} P\,r\,dr$$

and Fe is obviously larger when the clearance is smaller. When the values of P explicitly given above for each range of r are substituted under the integrals, the equation for the force can be integrated in closed form. The resulting expression is too long and cumbersome to be set forth here, but can be readily derived by a person skilled in the art, and can be easily programmed in a computer for quantitative evaluation. For the purposes of this discussion is here abbreviated as $$Fe=DPe\ f(R1,R2,R3,c).$$

where f ( ) is a function of the geometry of the thrust bearing only.

Figure 5:
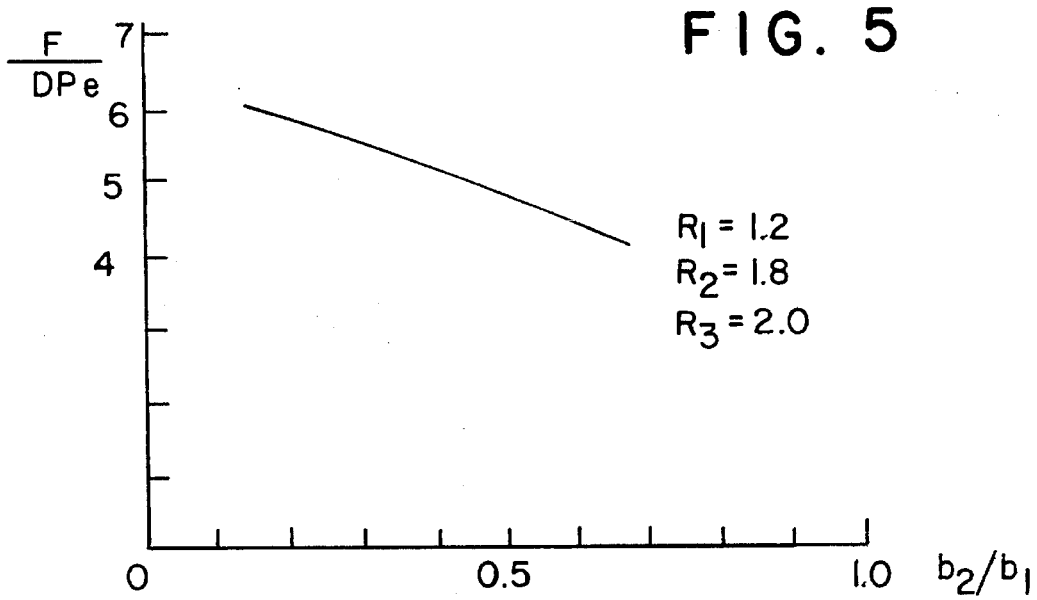
FIG. 5 is a graphical representation of the variations in force as a function of displacement for a typical set of radius values.

FIG. 5 is a graphic presentation of the variation of the force with displacement b2, for a typical set of values R1, R2, R3 and a constant step height b1-b2. As indicated in FIG. 5, the force increases inversely to the gap, therefore, the bearing has a stiffness proportional to the total pressure drop DPe as well as the total area between R1 and R3, and this is present even under static conditions (no rotation).

The rotating assembly can be maintained in the center of the axial clearance under static conditions if it is subjected to another force F1 exactly equal and opposite to the force F, which the thrust bearing generates when it is in the center of the clearance, i.e., for a specified value of ratio c=b1/b2. This new force F1 must be also proportional to DP, but must be independent of the axial displacement of the rotating assembly, so as to achieve equilibrium for any value of DPe but for one value of c only, namely that c which corresponds to the center of the clearance.

$$F1=-Fe=-DPe\ f(R1,R2,R3,c).$$

Thus the geometry of the compensation chamber must have an effective area A equal to f(R1,R2,R3,c).

It is a characteristic of centrifugal compressors that the space near the axis is not well utilized for the gas dynamics of the compression process. In practice, a typical compressor wheel has a relatively large hub, and the leading edges of the blades occupy a relatively narrow annular space around the hub. This underutilized space around the axis can be advantageously used to accommodate a compensation chamber designated in FIG. 2 by the numeral 90.

The second, or compressor wheel 62, is backed by previously identified thrust bearing 70, which has a structure generally similar to that disposed behind the first or turbine wheel 60. Formed within closure member 67 is a generally annular shaped inlet manifold 94. A radial diffuser 96 interconnects the discharge of wheel 62 with a discharge manifold 98 in the manner shown in FIG. 2. Duct means, shown here as duct 100, in turn, connects discharge manifold 98 with a distribution groove 102 which is located proximate the center of bore 52. With this construction, it is apparent that grooves 64 are at whatever pressure Pg is present in discharge manifold 98. Hence, pressure Pg is distributed both to edge 88 which is disposed behind the wheel 60 and to a space 104 that is provided in support 50 proximate wheel 62. Therefore, thrust bearing 70 is subjected to a pressure difference DPc=Pc–Pg, where Pc is the pressure at an edge 106 formed on support 50 proximate wheel 62 and the force developed is:

$$Fc=DPc\ f(R1,R4,R5,c)$$

where R4 and R5 are the radii corresponding to a step 108 formed on support 50 and edge 106 in exact analogy to radii R2 and R3 of the thrust bearing 68. It is to be understood that flow through the thrust bearings is substantially laminar to ensure bearings stability.

Under static conditions the pressure is uniform throughout the compressor because the machine is not rotating and no centrifugal forces are in play. Therefore, Pg=Pc, DPc=0 and Fc=0. However, when shaft 56 is rotated, the pressure Pi present in inlet manifold 94 is incremented by the action of the wheel 62 to Pc>Pi and then by the action of the diffuser 96 to Pg>Pc.

It is to be observed that shaft 56, which connects turbine wheel 60 with compressor wheel 62 is provided with a longitudinally extending bore 110 which causes the pressure in compensation chamber 90 to be equal to the pressure Po present near the center of wheel 60 and substantially equal to the pressure in the exhaust manifold **65*a* of the turbine. Chamber 90 which is located proximate the hub 62*a* of compressor wheel 62 is bounded by a cylindrical surface 112 which is concentric with the axis of shaft 56 and has a radius R6. Chamber 90 is closed by a labyrinth 114 which comprises a multiplicity of circumferential teeth-like protuberances 116 which are concentric with and in close proximity to cylindrical surface 112. Labyrinth 114 effectively separates gases at pressure Po, which are present in chamber 90**, from gases at pressure Pi present at the eye of the compressor wheel.

Pressure difference Pg–Po acts on the annular area between edge **104*a* and surface 112**, corresponding to radii R1 and R6, hence it develops a force:

$$F1=\pi(Pg-Po)\ (R6^2-R1^2).$$

Under static conditions Po=Pe and R6 can be chosen so that F1 exactly balances Fe, namely:

$$R6=R1+f(R1,R2,R3,c)/\pi.$$

In this case the thrust is balanced for any pressure difference Pg–Po.

Under dynamic conditions the static portion of the thrust remains balanced, but the dynamic portion does not. The pressure at the edge 84 of wheel 60 is no longer equal to the pressure at the center Po, and the pressure at edges 88 and 212, 104 which is equal to the final pressure Pg developed by the compressor, is no longer equal to the inlet pressure Pi. It is still possible to balance the thrust under these conditions, however, by choosing R4 and R5 of thrust bearing 70, so far unspecified, such that:

$$DPc\ f(R1,R4,R5,c)=DPe\ f(R1,R2,R3,c).$$

As long as the dynamic pressure increments remain proportional to each other during the operation of the turbocompressor, thrust will remain balanced at any speed from static to normal operation.

In the previous discussion, it has been assumed that pressures on the compressor wheel side of the apparatus are greater than pressures on the turbine wheel side of the apparatus. However, if this condition is reversed, it will be obvious to one skilled in the art, that the foregoing analysis will apply with equal efficacy and that calculations along the same lines can be made to accommodate this condition.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A turbocompressor comprising:

(a) a support having a longitudinally extending bore, generally circular in cross section at any point, said bore being of a predetermined diameter and defining an inner surface, said support being disposed within a fluid atmosphere and including longitudinally spaced first and second faces, each of said faces having a recess provided therein which is concentric with said bore and in fluid communication therewith;

(b) an elongated, generally cylindrical shaft rotatable within said bore of said support, said shaft having first and second ends and including a longitudinally extending bore therethrough, said shaft being of a predetermined diameter less than the diameter of said bore in said support and having an outer surface provided with a plurality of circumferentially spaced, longitudinally extending grooves;

(c) a first closure member connected to said support to define in cooperation with said first face, a first chamber, said first chamber being at an average static first pressure;

(d) a first wheel disposed within said first chamber and connected to said first end of said shaft for rotation therewith, said first wheel being subjected to a first axial force;

(e) a second closure member connected to said support to define, in cooperation with said second face, a second chamber, said second chamber being at an average static second pressure;

(f) a second wheel disposed within said second chamber and connected to said second end of said shaft for rotation therewith, said second wheel being subjected to a second axial force; and (g) equalizing means for substantially equalizing said first and second axial forces upon rotation of said shaft within said bore in said support, whereby said shaft will remain substantially axially centered within said bore in said support.

2. A turbocompressor as defined in claim 1 in which said first and second wheels include inner faces and in which said equalizing means comprise first and second fluid operated thrust bearings provided between said inner faces of said first and second wheels and said first and second faces of said support respectively, said recesses in said faces of said support having a depth such that flow therein is substantially laminar.

3. A turbocompressor comprising:

(a) a support having a longitudinally extending bore, generally circular in cross section at any point, said bore defining an inner surface, said support being disposed within a gaseous atmosphere and including longitudinally spaced first and second faces, each of said faces having a thrust bearing defining recess provided therein which is concentric with said bore and in fluid communication therewith;

(b) en elongated, generally cylindrical shaft rotatable within said bore of the support, said shaft having first and second ends and including a longitudinally extending bore therethrough, said shaft having an outer surface provided with a plurality of circumferentially spaced, longitudinally extending grooves, each of said grooves being in fluid communication with said thrust bearing defining recesses formed in said longitudinally spaced faces of said support;

(c) a first closure member connected to said support to define in cooperation with said first face, a first chamber, said first chamber being at a first pressure;

(d) a first wheel disposed within said first chamber and connected to said first end of said shaft for rotation therewith, said first wheel having an inner face and being subjected to a first axial force;

(e) a second closure member connected to said support to define, in cooperation with said second face, a second chamber, said second chamber being at a second pressure greater than said first pressure;

(f) a second wheel disposed within said second chamber and connected to said second end of said shaft for rotation therewith, said second wheel having an inner face and being subjected to a second axial force;

(g) an inlet manifold carried by said support, said inlet manifold being in communication with a selected one of said thrust bearing recesses;

(h) a discharge manifold carried by said support, said discharge manifold being in communication with said bore in said support;

(i) equalizing means for substantially equalizing said first and second axial forces, said equalizing means comprising first and second thrust bearings disposed between said first and second wheels and said recesses formed in said first and second faces of said support respectively; and (j) a compensation chamber in communication with said bore in said shaft, said bore in said shaft also being in communication with said center of said first wheel.

4. A turbocompressor as defined in claim 3 in which said support includes a distribution channel in fluid communication with said bore in said support and further includes duct means for creating a fluid passageway between said discharge manifold and said distribution channel.

5. A turbocompressor as defined in claim 3 wherein said compensation chamber is disposed between said second wheel and said second closure member.

6. A turbocompressor as defined in claim 3 in which flow through said thrust bearing recesses is substantially laminar by controlling the widths of said recesses.

7. A turbocompressor comprising:

(a) a support having a longitudinally extending bore, generally circular in cross section at any point, said bore being of a predetermined diameter and defining an inner surface, said support being disposed within a gaseous atmosphere and including longitudinally spaced first and second faces;

(b) en elongated, generally cylindrical shaft rotatable within said bore of said support, said shaft having first and second ends and including a longitudinally extending bore therethrough, said shaft being of a predetermined diameter less than the diameter of said bore in said support and having an outer surface provided with a plurality of circumferentially spaced, longitudinally extending grooves;

(c) a first closure member connected to said support to define in cooperation with said first face, a first chamber, said first chamber being at an average static first pressure;

(d) a first wheel disposed within said first chamber and connected to said first end of said shaft for rotation therewith, said first wheel having an inner face and being subjected to a first axial force;

(e) a second closure member connected to said support to define, in cooperation with said second face, a second chamber, said second chamber being at an average static second pressure;

(f) a second wheel disposed within said second chamber and connected to said second end of said shaft for rotation therewith, said second wheel having an inner face being subjected to a second axial force; and (g) equalizing means for substantially equalizing said first and second axial forces upon rotation of said shaft within said bore in said support, whereby said shaft will remain substantially axially centered within said bore in said support, said equalizing means comprising first and second gas operated thrust bearings provided between said inner faces of said first and second wheels and said first and second faces of said support respectively; and (h) a discharge manifold in communication with said bore in said support and a compensation chamber in communication with said longitudinally extending bore in said shaft, said bore in said shaft also being in communication with said first thrust bearing.

8. A turbocompressor as defined in claim 7 in which said support includes a centrally disposed distribution channel in fluid communication with said bore and further includes duct means for creating a fluid passageway between said discharge manifold and said distribution channel.

9. A turbocompressor comprising:

(a) a support having a longitudinally extending bore, generally circular in cross section at any point, said bore being of a predetermined diameter and defining an inner surface, said support being disposed within a gaseous atmosphere and including longitudinally spaced first and second faces each of said faces having a recess provided therein which is concentric with said bore and in fluid communication therewith;

(b) en elongated, generally cylindrical shaft rotatable within said bore of the support, said shaft having first and second ends and including a longitudinally extending bore therethrough, said shaft being of a predetermined diameter less than the diameter of said bore in said support and having an outer surface provided with a plurality of circumferentially spaced, longitudinally extending grooves, each of said grooves being in fluid communication with said recesses formed in said faces of said support;

(c) a first closure member connected to said support to define in cooperation with said first face, a first chamber, said first chamber being at an average static first pressure;

(d) a first wheel disposed within said first chamber and connected to said first end of said shaft for rotation therewith, said first wheel having a center and being subjected to a first axial force;

(e) a second closure member connected to said support to define, in cooperation with said second face, a second chamber, said second chamber being at an average static second pressure;

(f) a second wheel disposed within said second chamber and connected to said second end of said shaft for rotation therewith, said second wheel being subjected to a second axial force;

(g) equalizing means for substantially equalizing said first and second axial forces upon rotation of said shaft, said equalizing means comprising first and second thrust bearings disposed between said first and second wheels and said recesses formed in said first and second faces of said support respectively; and (h) a compensation chamber in communication with said bore in said shaft, said bore in said shaft also being in communication with said first thrust bearing.

10. A turbocompressor as defined in claim 9 further including a discharge manifold in communication with said bore in said support and in which said support includes a centrally disposed distribution channel in fluid communication with said bore and further includes duct means for creating a fluid passageway between said discharge manifold and said distribution channel.

11. A turbocompressor as defined in claim 9 in which said compensation chamber is in communication with said center of said first wheel and has a predetermined geometric relationship with said thrust bearings.

* * * * *